United States Patent [19]

Sato

[11] Patent Number: 4,936,126

[45] Date of Patent: Jun. 26, 1990

[54] PRESS BRAKE WITH A DISPLACEMENT SENSOR OF ELECTRIC SIGNAL OUTPUT

[75] Inventor: Hiroshi Sato, Fujisawa, Japan

[73] Assignee: Daiichi Electric Co., Ltd., Fujisawa, Japan

[21] Appl. No.: 194,969

[22] Filed: May 17, 1988

[51] Int. Cl.[5] ..... B21D 37/00

[52] U.S. Cl. ..... 72/21; 72/389; 72/1; 72/26; 72/30; 72/446

[58] Field of Search ..... 72/21, 1, 389, 15, 22, 72/26, 30, 446; 100/46, 48

[56] References Cited

U.S. PATENT DOCUMENTS 4,148,203 4/1979 Farazandeh et al. ..... 72/21

FOREIGN PATENT DOCUMENTS 0114600 9/1981 Japan ..... 100/46
0224098 12/1983 Japan ..... 100/46
0224100 12/1983 Japan ..... 100/46
0126932 6/1986 Japan ..... 72/21
0040934 2/1987 Japan ..... 72/21
306449 4/1955 Switzerland ..... 100/46

*Primary Examiner*—David Jones
*Attorney, Agent, or Firm*—Wenderoth, Lind & Ponack

[57] ABSTRACT

A press brake with a displacement sensor of an electric signal output has a base distance portion; a displacement sensor disposed opposite the base distance portion and having an electric signal output; a pair of dies one of the molds being provided with either the base distance portion or the displacement sensor, the other being provided with the remaining one of the base distance portion or the displacement sensor through a linear actuator; a servo amplifier for inputting an electric signal output coming from the displacement sensor; a servo valve controlled by an output signal coming from the servo amplifier; and a cylinder controlled by the servo valve and adapted to actuate either one of the pair of dies.

1 Claim, 4 Drawing Sheets

PRESS BRAKE WITH A DISPLACEMENT SENSOR OF ELECTRIC SIGNAL OUTPUT

BACKGROUND OF THE INVENTION

This invention relates broadly to a mechanical press, and particularly to a press brake having a linear actuator.

More particularly, the present invention relates to a press brake comprising a displacement sensor having an electric signal output and adapted to detect the position of a ram plate.

In general, a press brake used for bending sheet metal or the like is required to control the position of its ram plate with very high accuracy.

For example, as is shown in a side view of FIGS. 2*a* and 2*b* (FIG. 1 shows the present invention and will therefore be described afterward), a plate such as a metal plate 20 or the like is interposed between an upper die 11 and a lower die 12 and pressed so that the plate is usually bent at an angle of 90°. However, since the accuracy required for the press brake is so high, bent plates with errors within +0.5 with respect to a target angle of 90° are rejected.

Therefore, the control of the pressing position of the upper die 11 is required to be so accurate that the errors must usually remain within 1/100 mm, approximately. Besides, a large amount of power is required for bending a wide plate member. To this end, the usual practice is that a pressure is applied to both ends of a ram plate 30 by a hydraulic cylinder 40 (see FIG. 3). Of course, the upper die 11 can be held stationary and the lower die 12 can be pushed up. Right and left cylinders 41 and 42 are required to be synchroneously driven with high accuracy. However, when a workpiece is interposed between the upper die 11 and the lower die 12, it is often displaced leftward or rightward, and when displaced, a one-sided load is created. Since the load is not equally applied to the right and left cylinders 41 and 42, it is very difficult for them to be driven in synchronism.

The plate which is the workpiece is not always required to be bent at an equal angle. Sometimes it is required that the bending angle of the left end of the plate be different from that of the right end as shown in the perspective view of FIG. 4. In this case, the pressure must be applied to the ram 30 held in an inclined state as shown in FIG. 5 with synchroneous drive of the cylinders 41 and 42.

Such control is generally obtainable by detecting the movement (displacement) of the ram plate 30 by a linear scale and feeding it back to a servo valve or a proportional control valve for controlling the cylinders 41 and 42. If this is carried out according to an analog system, a satisfactory control can be obtained. However, it is not easy to obtain an accuracy of 1/100 mm over the whole stroke. On the other hand, if a digital system is adopted, the detection of the displacement and the control of the cylinder are usually made by a microcomputer. In this case, if the displacement is to be read to the limit of discrimination of the linear scale by computer, it takes too much time for reading and controlling, and the speed of action of the cylinder is proportionately lowered. If some data from the linear scale is intentionally not read in order to save time, the result is the same as if the discrimination of the linear scale was made rough. This means that the synchroneous drive of the right and left cylinders becomes insufficient.

There is also known a press brake having a mechanical feed mechanism as shown in the front view of FIG. 6. In this conventional press brake, a plunger of a 4-port switch valve 60 is pushed by a linear actuator 50 (e.g., a combination of a rotary encoder, a servo motor, ball screw, etc.) for switching the port, thereby to actuate a hydraulic cylinder 40 to follow the ram plate 30. In other words, the ram plate 20 is caused to follow the movement of the linear actuator 50 by using a mechanical feed back system.

However, this system has the shortcoming that it is very difficult to switch the port by a minor displacement of the plunger. In order to respond to the minor displacement, the mechanical accuracy of the spool and port must be extremely good or the movement of the linear actuator must be increased according to the principle of a lever. However, if a lever mechanism is introduced into such an arrangement, it becomes very unstable in the areas of such things as initial adjustment, change due to age, or the like.

In the case of a mechanical feed back servo control, the feed back loop gain cannot be adjusted during the operation test. Even if a mechanical system is taken into consideration, it becomes complicated and always has such problems as change due to age or the like. When a plate member is bent by actually applying pressure thereto, since the jaw portion of a frame 6 shown in a side view of FIG. 7 is spread, the cylinder 40 must be further pushed down to that extent. This means that in order to accurately control the actual distance D between the upper die 11 and the lower die 12, it is necessary to know the amount of spread of the frame 6 as data beforehand. This always causes difficulties in control.

The present invention has been accomplished in order to overcome the above-described problems.

SUMMARY OF THE INVENTION

It is therefore a general object of the present invention to provide a press brake with a displacement sensor having an electric signal output, wherein a pair of right and left cylinders are perfectly synchroneously driven, the synchroneous drive is not adversely affected even if a ram plate is held in an inclined state, and the control speed is enhanced.

More specifically, in a press brake, in order to accurately bend a plate member, the distance between the upper die and the lower die must be accurately controlled. To this end, the lower die is provided with a linear actuator. The distance between the movable front end portion of the linear actuator and the upper die is measured by a displacement sensor. A minor change, if it occurs, of the distance is output as an electric signal by a converter so as to control a hydraulic cylinder via an amplifier, thereby to maintain the distance between the upper die and the lower die constant.

A specific structure of a press brake with a displacement sensor having an electric signal output according to the present invention will be described in detail.

It has a base distance portion. It also has a displacement sensor having an electric signal output. The displacement sensor having an electric signal output is located opposite the base distance portion. It further has a pair of dies. One of the pair of dies is provided with either the base distance portion or the displacement sensor.

The other of the pair of dies is provided with the remaining one of the base distance portion or the displacement sensor. It further has a servo amplifier for inputting an output of an electric signal coming from the displacement sensor. It further has a servo valve controlled by an output signal coming from the servo amplifier. Lastly, it has a cylinder controlled by the servo valve. The cylinder is connected such that one of the pair of dies is actuated.

Since the press brake with a displacement sensor having an electric signal output according to the present invention is constructed in the manner as described above, it has the following effects.

The base distance portion mounted on either one of the pair of dies and the displacement sensor having an electric output mounted on the other die together detect the correctness of the distance between the pair of dies. The displacement sensor outputs an electric signal in accordance with the result. The electric signal output of the displacement sensor controls the servo valve through the servo amplifier. This, in turn, controls the cylinder. The cylinder is connected to either one of the pair of dies so as to move the latter in the vertical direction.

The base distance portion or the displacement sensor is connected to either one of the pair of dies, whereas the linear actuator is mounted on the other one of the pair of dies. The other one of the pair of dies is provided with the remaining one of the base distance portion or the displacement sensor. Accordingly, the distance between the pair of dies can be controlled by actuating the linear actuator.

The above and other objects and attendant advantages of the present invention will be apparent to those skilled in the art from a reading of the following description and claims in conjunction with the accompanying drawings which constitute part of this specification.

Figure 7:
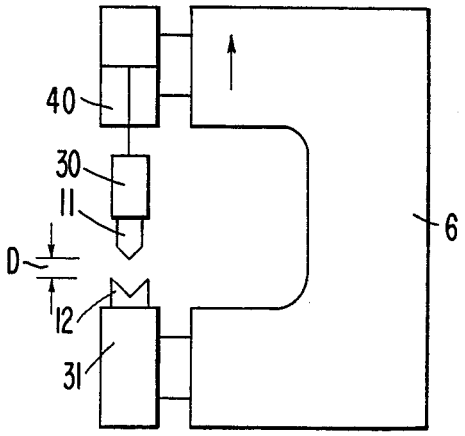
FIG. 7 (PRIOR ART)
Figure 2A:
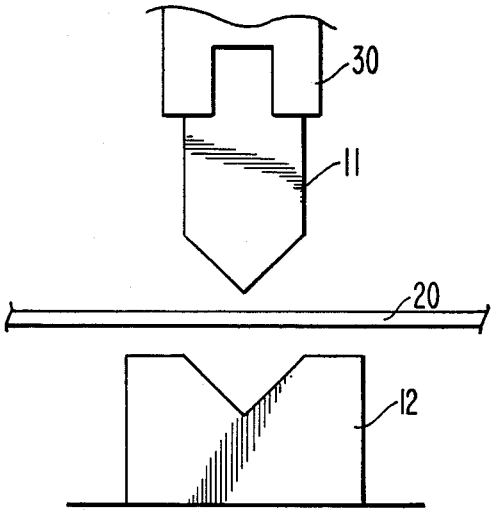
FIG. 2a (PRIOR ART)
Figure 2B:
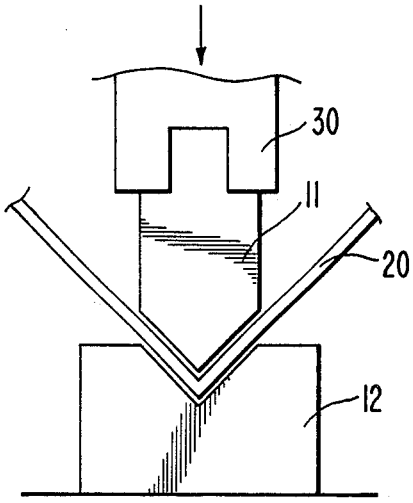
FIG. 2b (PRIOR ART)
Figure 3:
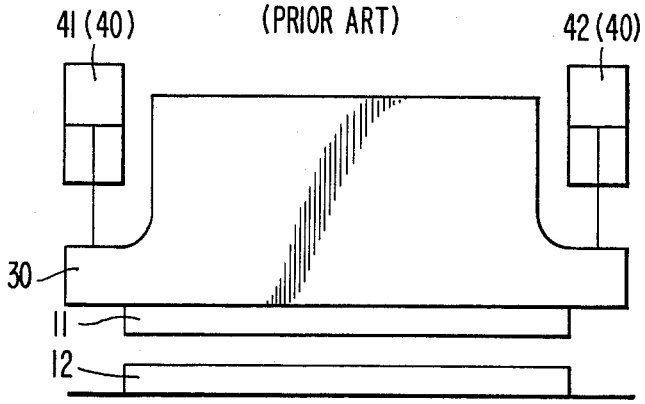
FIG. 3 (PRIOR ART)
Figure 6:
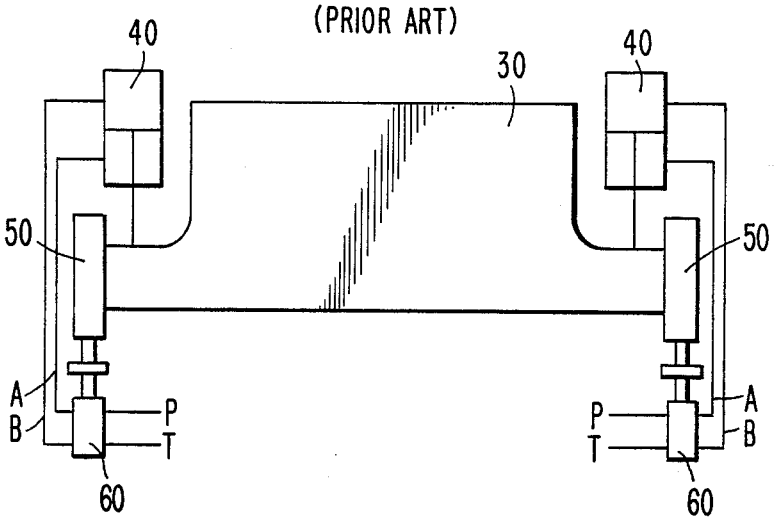
FIG. 6 (PRIOR ART)
Figure 4:
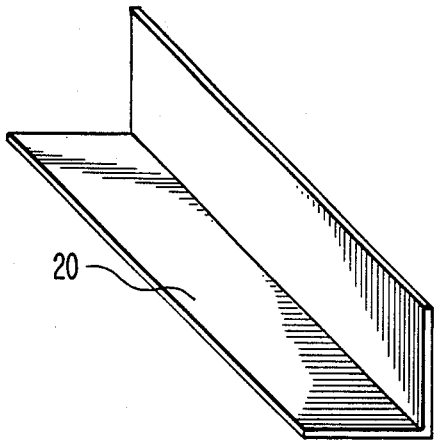
FIG. 4 (PRIOR ART)
Figure 5:
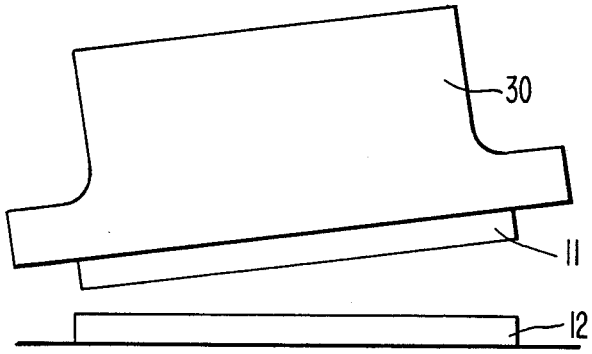
FIG. 5 (PRIOR ART)

FIGS. *2a* and *2b* are elevation views of a generally known pair of dies, wherein FIG. *2a* shows the dies before pressing a workpiece, and FIG. *2b* shows the dies pressing a workpiece;

FIG. 3 is a front view of a generally known ram plate;

FIG. 4 is a perspective view of one embodiment of a plate member already pressed;

FIG. 5 is a front view of one embodiment of a generally known ram plate;

FIG. 6 is a front view of one embodiment of a control portion of a conventional press brake; and FIG. 7 is an elevation view of one embodiment of a conventional press brake.

DETAILED DESCRIPTION OF THE INVENTION

A press brake with a displacement sensor having an electric signal output according to the present invention will be described in the form of a preferred embodiment in detail with reference to FIG. 1.

Figure 1:
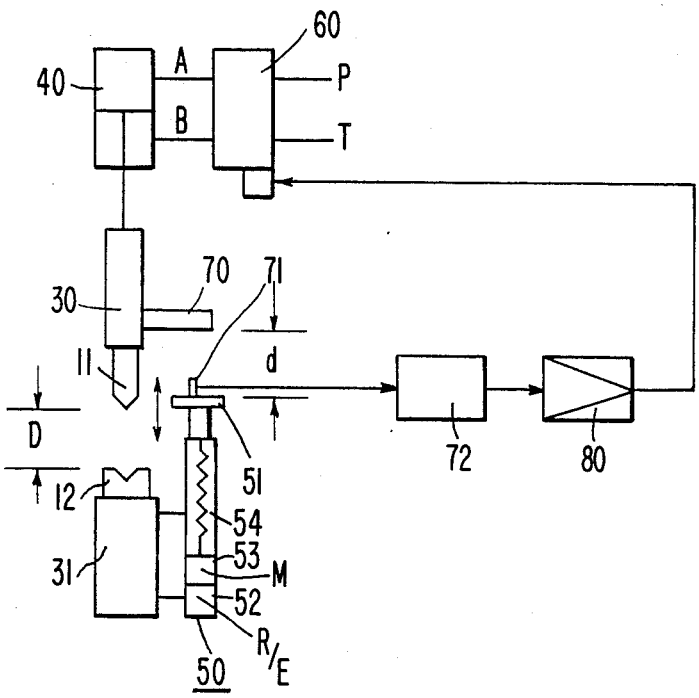
FIG. 1 is an elevation view of one embodiment of a press brake with a displacement sensor having an electric signal output according to the present invention.

In FIG. 1, reference numerals 11 and 12 denote a pair of dies. The upper die 11 is provided with a bar 70 as a means to indicate a base distance portion. The lower die 12 is held by a holding table 31. The holding table 31 is connected to a linear actuator 50. Distance control means is provided constituted by the linear actuator 50, a converter 72, a servo amplifier 80 and a servo valve 60. A front end 51 of a movable portion of the linear actuator 50 is provided with a displacement sensor 71 having an electric signal output. The displacement sensor 71 having an electric signal output is located opposite the bar 70. The output of the electric signal coming from the displacement sensor 71 is input to the converter 72 and then input to the servo amplifier 80. The servo valve 60 is controlled by an output signal coming from the servo amplifier 80. Reference numeral 40 denotes a cylinder assembly. The cylinder assembly 40 is controlled by the servo amplifier 80. The cylinder assembly 40 is connected to the upper die 11 so as to actuate the latter through a ram plate 30.

Although the bar 70 is mounted on the upper die 11 in the illustrated embodiment, it may be mounted on the front end 51 of the movable portion of the linear actuator 50 and the displacement sensor 71 having an electric signal output may be mounted on the upper die 11.

The operation of a press brake with a displacement sensor having an electric signal output according to the present invention will now be described.

The displacement sensor 71 can be a differential transformer type displacement gauge mounted on the movable end portion 51 of the linear actuator 50. The differential transformer type displacement gauge 71 is moved in the vertical direction by the linear actuator 50 to be positioned at the desired position where the upper and lower dies 11 and 12 are spaced at a distance D-d when upper die 11 has moved a distance d. The bar 70 forming the projection is mounted on the ram plate 30 or the upper die 11 so that the front end of a probe of the differential transformer type displacement gauge 71 and bar 70 can contact each other when the dies are moved together. The output of the differential transformer type displacement gauge 71 is converted to a direct current signal by the converter 72 and the servo valve 60 is driven through the servo amplifier 80 for changing over the supply of hydraulic fluid to cylinder assembly 40 for moving the hydraulic cylinder assembly 40 in the vertical direction. When the differential transformer type displacement gauge 71 is pushed up to its desired position by the linear actuator 50, it will be hit by the bar 70. If the distance d is shortened, this is detected by the differential transformer type displacement gauge 71. The servo valve 60 is actuated by the signal coming from the differential transformer type displacement gauge 71 and the hydraulic fluid supply is changed in that the ram plate 30 is pulled up by the hydraulic cylinder assembly 40. When the differential transformer type displacement gauge descends, the ram plate 30 also descends a further distance following the downward adjustment of the position of the differential transformer type displacement gauge 71. Therefore, the distance d can always be maintained at the desired value.

Because of the foregoing, the distance D-d between the upper die 11 and the lower die 12 at the end of the movement toward each other is changed in synchronism with the movement of the differential transformer 71. If a pair of the above-described distance control means are provided at opposite ends of a die, it is easy to provide a conventional current control means to electrically drive the right and left linear actuators 50 in synchronism. Accordingly, the hydraulic cylinder assembly, which is actuated following the movement of the right and left actuators 50, is also driven in synchronism. This means that, in the electric control portion of a microcomputer or the like, the accurate and rapid control of only the linear actuators 50 suffice to control the accuracy of movement of the die without taking into consideration the oil pressure portion of the servo valve 60 or the like. The oil pressure portion merely follows the movement of the linear actuators 50 in such a manner as to maintain the distance d between each linear actuator 50 and each bar 70 always constant by the differential transformer type displacement gauge 71. In the construction as just described, the spreading of the jaw portion of the frame 6 (see FIG. 6), which is caused when a large pressure is applied, is automatically offset and the distance D between the upper die 11 and the lower die 12 can always be well controlled.

The same effects are obtainable even if the linear actuator 50 is mounted on the upper die 11 and the bar 70 is mounted on the lower die 12. The present invention is of course not limited to these. Instead, various other combinations can be made by those skilled in the art. Although the differential transformer type displacement gauge 71 is employed in the present embodiment in order to measure the distance d, a noncontact type displacement gauge, in which light, air, etc. are used, may be employed instead of a contact type displacement gauge. According to the controlling system of the present invention, in the electric controlling portion, the linear actuator 50 mounted on the upper die 11 or the lower die 12 is accurately and rapidly actuated, the distance d between the linear actuator 50 and the projection for the use of measurement mounted on the remaining upper die 11 or lower die 12 is measured, and the hydraulic cylinder assembly is operated such that the distance is always maintained constant.

The linear actuator 40 employed in the embodiment generally comprises a servo motor 53 with a pulse encoder 52 and a ball screw 54 combined with the servo motor 53. However, the present invention is not limited to the above. Any other type of linear actuator may be employed as long as it moves linearly and has generally the same accuracy as a linear scale.

Since a press brake with a displacement sensor having an electric signal output according to the present invention is constituted such as described in the foregoing, the power cylinder can be controlled rapidly and accurately.

As for the electric control thereof, it suffices that only the linear actuator need be accurately and rapidly controlled and the oil pressure portion may be disregarded for this purpose. Accordingly, the electric portion and the oil pressure portion can be separately adjusted. Thus, much time and labor can be saved in manufacturing.

Although the present invention has been described in its preferred form with a certain degree of particularity, it is understood that the present disclosure of the preferred form has been made only by way of example and that numerous changes in the details of construction and arrangement of parts may be resorted to without departing from the spirit and the scope of the present invention as hereinafter claimed.

What is claimed is:

1. A press brake with a displacement sensor having an electric signal output, comprising:

a pair of material shaping dies movable and away from each other;

a base distance indicator on one of said dies;

a movable member for supporting a displacement sensor and positioned opposite said base indicator;

a linear actuator for adjusting the position of said movable member toward and away from said one die, said movable member being mounted on said linear actuator and said linear actuator being mounted on the other of said dies;

a displacement sensor for outputting a signal when contacting an object and mounted on said movable member and disposed opposite said base distance indicator and outputting an electric signal when contacted by said base distance indicator as the position of said displacement sensor relative to the other of said dies is adjusted by operation of said linear actuator;

a cylinder for moving one of said dies and connected to said one of said dies;

a servo valve for changing the hydraulic fluid supply to cause said cylinder to move said one of said dies away from the other of said dies and being connected in the hydraulic fluid supply to said cylinder; and a servo amplifier for receiving electric signal output from said displacement sensor indicating that said displacement sensor has been contacted by said base distance indicator and supplying an output signal for controlling said servo valve for changing the hydraulic fluid supply, said servo amplifier being connected to said servo valve.

* * * * *